US008308444B2

(12) United States Patent
Andrews

(10) Patent No.: US 8,308,444 B2
(45) Date of Patent: Nov. 13, 2012

(54) FLUID PRESSURE EXCHANGE MECHANISM AND METHOD OF OPERATING SAME

(75) Inventor: William T. Andrews, Paget (BM)

(73) Assignee: Flowserve Holdings, Inc., Irving, TX (US)

( * ) Notice: Subject to any disclaimer, the term of this patent is extended or adjusted under 35 U.S.C. 154(b) by 850 days.

(21) Appl. No.: 12/092,970

(22) PCT Filed: Nov. 14, 2006

(86) PCT No.: PCT/GB2006/004236

§ 371 (c)(1),
(2), (4) Date: Nov. 11, 2008

(87) PCT Pub. No.: WO2007/057650

PCT Pub. Date: May 24, 2007

(65) Prior Publication Data

US 2009/0185917 A1 Jul. 23, 2009

(30) Foreign Application Priority Data

Nov. 15, 2005 (GB) ..... 0523265.7

(51) Int. Cl.
*F04F 13/00* (2009.01)
*F04B 19/00* (2006.01)

(52) U.S. Cl. ..... 417/64; 417/53; 417/63

(58) Field of Classification Search ..... 417/53, 417/63, 64

See application file for complete search history.

(56) References Cited

U.S. PATENT DOCUMENTS

| | | | | |
|---|---|---|---|---|
| 2,630,975 | A * | 3/1953 | Horth | 241/132 |
| 3,489,159 | A | 1/1970 | Chen-Yen Cheng et al. | |
| 4,887,942 | A | 12/1989 | Hauge | |
| 5,306,428 | A | 4/1994 | Tonner | |
| 5,797,429 | A | 8/1998 | Shumway | |
| 6,205,960 | B1 * | 3/2001 | Vallejos | 123/44 R |
| 6,537,035 | B2 | 3/2003 | Shumway | |
| 7,214,315 | B2 * | 5/2007 | Shumway | 210/321.66 |
| 2006/0032808 | A1 * | 2/2006 | Hauge | 210/321.65 |
| 2006/0054223 | A1 * | 3/2006 | Baumgarten et al. | 137/625.19 |
| 2006/0213207 | A1 * | 9/2006 | Redlich | 62/6 |

FOREIGN PATENT DOCUMENTS

| | | |
|---|---|---|
| GB | 1470956 A | 4/1977 |
| WO | WO-2004/111509 | 12/2004 |

OTHER PUBLICATIONS

International Search Report and Written Opinion dated Oct. 5, 2011, pertaining to International Application Serial No. PCT/US2011/042923.

* cited by examiner

*Primary Examiner* — Tracie Y Green
(74) *Attorney, Agent, or Firm* — Dinsmore & Shohl LLP

(57) ABSTRACT

A device and method configured to exchange pressures between fluid streams as a way to reuse the pressure energy of one of the fluids. The device includes a rotatable valve that fluidly cooperates with pressure exchange ducts so that a high pressure fluid stream flows into a high pressure exchange duct to displace a duct piston contained therein so that a fluid within this duct that is downstream of the piston is pressurized. At the same time, a low pressure fluid stream is introduced into a low pressure exchange duct to displace a duct piston contained therein so that a fluid within this duct that is downstream of its piston is pressurized. Rotation of the valve fluidly couples the pressurized fluid from the high pressure duct to the low pressure duct while the fluid from the low pressure duct becomes fluidly coupled to the high pressure duct.

15 Claims, 10 Drawing Sheets

Section A-A Section B-B

FLUID PRESSURE EXCHANGE MECHANISM AND METHOD OF OPERATING SAME

The present invention relates to a pressure exchanger machine. The preferred embodiments disclosed below utilize fixed exchange ducts and a rotary valve element.

Such pressure exchangers are sometimes called 'flow-work exchangers' or 'isobaric devices' and are machines for exchanging pressure energy from a relatively high pressure flowing fluid system to a relatively low pressure flowing fluid system. The term fluid as used herein includes gases, liquids and pumpable mixtures of liquids and solids.

In processes where a fluid is made to flow under pressure, only a relatively small amount of the total energy input is consumed in the pressurizing of the fluid, the bulk of the energy being consumed in maintaining the fluid in flow under pressure. For this reason, continuous flow operation requires much greater energy consumption than non-flow pressurization. In summary, the power required to maintain flow under pressure is proportional to the mass flow rate multiplied by the increase in pressure.

In some industrial processes, elevated pressures are required in certain parts of the operation to achieve the desired results, following which the pressurized fluid is depressurized. In other processes, some fluids used in the process are available at high pressures and others at low pressures, and it is desirable to exchange pressure energy between these two fluids. As a result, in some applications, great improvement in economy can be realized if pressure exchange can be efficiently transferred between two fluids.

By way of illustration, there are industrial processes where a catalyst is utilized at high pressure to cause a chemical reaction in a fluid to take place and, once the reaction has taken place, the fluid is no longer required to be at high pressure, rather a fresh supply of fluid is required at high pressure. In such a process, a pressure exchanger machine can be utilized to transfer the pressure of the reacted high pressure fluid to the fresh supply of fluid, thus improving the economy of the process, by requiring less pumping energy be supplied.

Another example where a pressure exchange machine finds application is in the purification of saline solution using the reverse osmosis membrane process. In this process, an input saline solution stream is continuously pumped to high pressure and provided to a membrane array. The input saline solution stream is continuously divided by the membrane array into a super saline solution (brine) stream which is still at relatively high pressure and purified water stream at relatively low pressure. While the high pressure brine stream is no longer useful in this process as a fluid, the flow pressure energy that it contains has a high value. A pressure exchange machine is employed to recover the flow pressure energy in the brine stream and transfer it to a input saline solution stream. After transfer of the pressure energy from the brine stream, the brine is expelled at low pressure to drain by the low pressure input saline solution stream. Thus, the use of the pressure exchanger machine reduces the amount of pumping energy required to pressurize the input saline solution stream. Accordingly, pressure exchanger machines of varying designs are well known in the art.

U.S. Pat. No. 4,887,942, as modified by U.S. Pat. No. 6,537,035, teaches a pressure exchanger machine for transfer of pressure energy from a liquid flow of one liquid system to a liquid flow of another liquid system. This pressure exchanger machine comprises a housing with an inlet and outlet duct for each liquid flow, and a cylindrical rotor arranged in the housing and adapted to rotate about its longitudinal axis. The cylindrical rotor is provided with a number of passages or bores extending parallel to the longitudinal axis and having an opening at each end. A piston or free piston may be inserted into each bore for separation of the liquid systems. The cylindrical rotor may be driven by a rotating shaft or by forces imparted by fluid flow. Since multiple passages or bores are aligned with the inlet and outlet ducts of both liquid systems at all times the flow in both liquid systems is essentially continuous and smooth. High rotational and thus high cyclic speed of the machine can be achieved, due to the nature of the device, with a single rotating moving part, which in turn inversely reduces the volume of the passages or bores in the rotor, resulting in a compact and economical machine.

U.S. Pat. No. 3,489,159, U.S. Pat. No. 5,306,428, U.S. Pat. No. 5,797,429 and WO-2004/111,509 all describe an alternative arrangement for a pressure exchanger machine, which utilizes one or more fixed exchanger vessels, with various valve arrangements at each end of such vessel(s). These machines have the advantage of there being no clear limit to scaling up in size and, with the device of WO-2004/111,509, leakage between the high pressure and low pressure streams can be minimized. A piston may be inserted into each exchanger vessel for separation of the liquid systems.

Disadvantages of pressure exchange machines based upon U.S. Pat. No. 4,887,942 can include:

that for high flow rates it is necessary to increase the size of the cylindrical rotor, and there are limitations on the amount that such a rotor can be scaled up as the centrifugal forces will attempt to break apart the rotor, similar to the problems encountered in scaling up flywheels to large sizes and speeds;

that very small clearances are required between the cylindrical rotor ends and the inlet and outlet ducts to maintain low rates of leakage between the high pressure and low pressure fluid systems, with such leakage causing a reduction in efficiency and it being difficult to maintain such small clearances;

that when operated at relatively high rotational speeds, it may not be practical to utilize a driven shaft to control rotation of the rotor, rather by non-linear forces imparted by fluid flow which can reduce the flow range over which a given device can operate efficiently; and that when operated at relatively high rotational speeds, it may not be practical to utilize a piston in the passages in the rotor, thus reducing efficiency by increasing mixing between the two fluid streams.

Disadvantages of pressure exchange machines based upon U.S. Pat. No. 3,489,159 can include:

that the flow in both fluid systems is not essentially continuous and smooth unless a large number of exchanger vessels are utilized;

that these devices are generally limited to low cyclic speeds due to the linear or separated nature of the valves, thus requiring relatively large volume exchanger vessels, which increases cost and size; and that due to the multiple moving parts, these devices tend to be more complex and expensive to manufacture than devices based upon U.S. Pat. No. 4,887,942.

The present invention seeks to provide an improved pressure exchanger.

According to an aspect of the present invention, there is provided a pressure exchanger machine for exchanging pressure in a flow stream at relatively high pressure to a second flow stream at relatively low pressure, including:

a rotary valve element for directing and isolating flows;

first and second exchange ducts separate from the rotary valve element; and a pressure vessel arranged to provide first and second compartments for hydraulically connecting high or low pressure flows to the valve element.

Advantageously, there is provided a single valve element. The provision of a single valve element reduces complexity of the exchanger while improving operability thereof.

In the preferred embodiment, the valve element includes first and second valves on a common driven rotating shaft. This has the benefit that the axial hydraulic forces are substantially balanced and the two valves operate substantially synchronously.

Advantageously, the machine includes fixed exchange ducts which are not part of a rotating component. This has the benefit that the machine can be scaled up in size to accommodate very high flows.

Advantageously, in the preferred embodiment the machine is provided with a plurality of exchange ducts. This allows the machine to provide substantially continuous and smooth flow in both fluid systems.

The exchanger is preferably provided with sealing surfaces on or adjacent to the rotating valve part, in order to reduce leakage between the different fluid systems of the machine. Such surfaces could also act as hydrodynamic bearings for radial support of the rotating valve part.

The exchanger may be provided with one or more pistons in each exchange duct to reduce mixing between the different fluid systems.

The preferred embodiments can provide a pressure exchanger machine which can be scaled up in size to accommodate very high flow; can provide substantially continuous and smooth flow in both fluid systems; can utilize a single rotating valve element for switching flows to the exchange ducts to reduce complexity and leakage between the two fluid systems; can have relatively high rotational speed of the valve element to reduce exchange duct volume requirements; can have a driven rotating shaft on the valve element to allow a wide flow range over which the machine can operate efficiently; can have substantially balanced hydraulic forces on the valve element to reduce bearing requirements; can have minimal leakage between the high pressure and low pressure fluid systems; and can allow for optional use of piston(s) in the exchange ducts to reduce mixing between the different fluid systems; while ensuring reliability, efficiency, economy and maintainability of the machine.

According to another aspect of the present invention, there is provided a method of exchanging pressure between different fluid flows, including the steps of providing a pressure exchanger machine including a plurality of exchange ducts mounted on a non-rotating part of the machine; a rotating valve element or elements; and a pressure vessel surrounding the exchange ducts and including first and second compartments and inlet and outlet flow connections; providing for the passage of high or low pressure flows to or from the compartments through the exchange ducts by means of the valve element or elements; and adjusting the fluid flows so as to adjust the pressure exchange effected by the machine by rotating the valve element or elements while keeping the exchange ducts still.

Embodiments of the present invention are described below, by way of example only, with reference to the accompanying drawings, in which.

Figure 1:
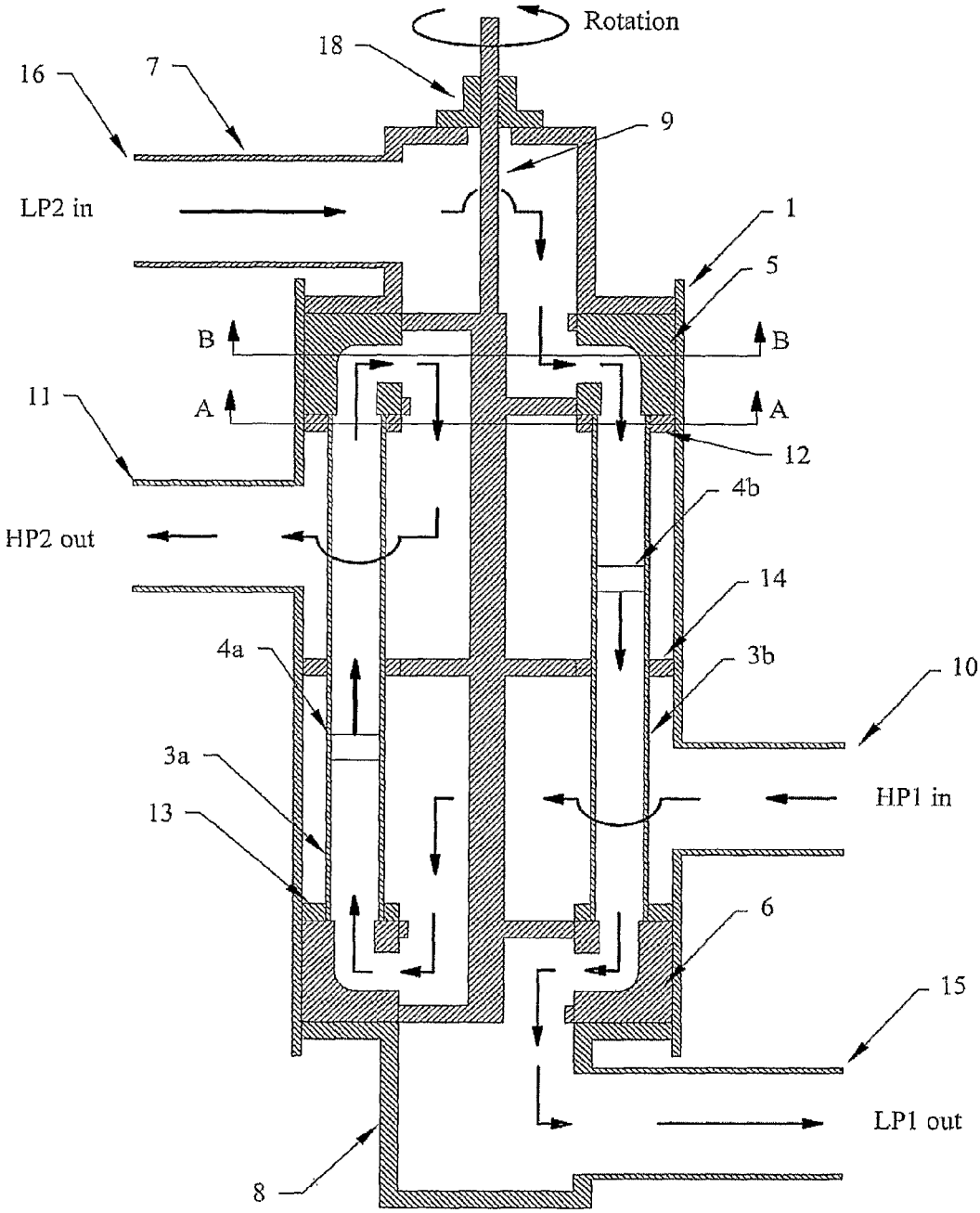
FIG. 1 is a cross-sectional view in simplified form of an embodiment of the exchanger.
Figure 2A:
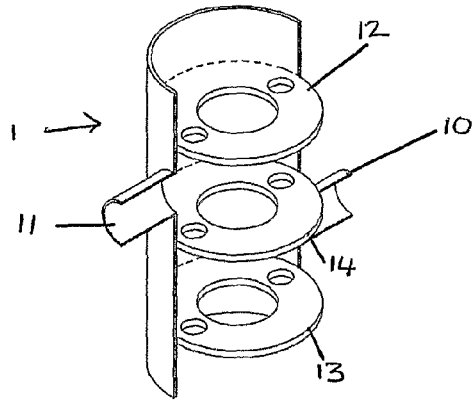
FIG. 2 is a cross-sectional view of the pressure vessel of the exchanger of FIG. 1.
Figure 2:
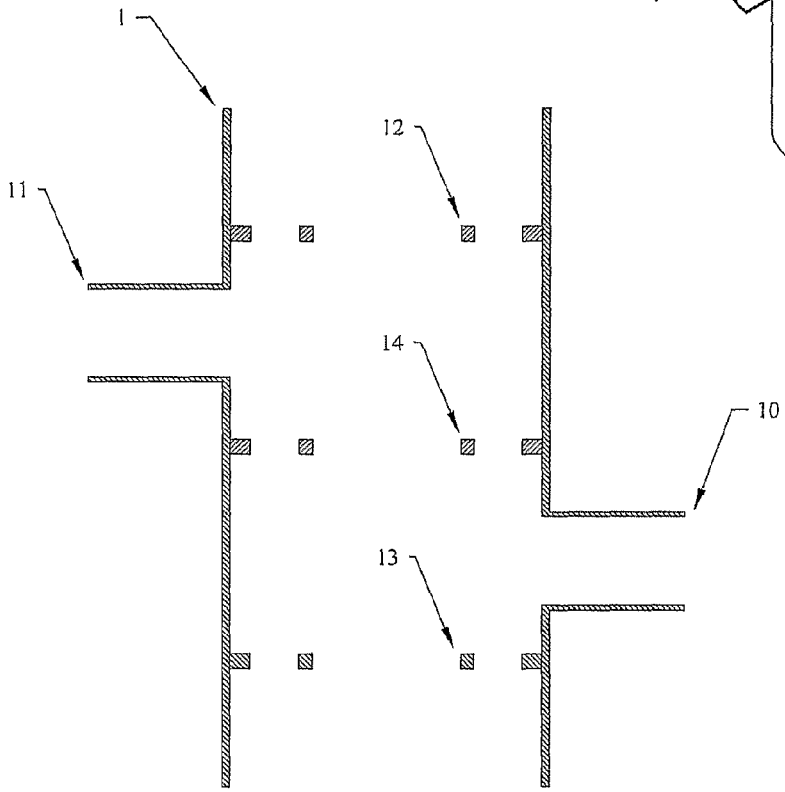
Figure 3:
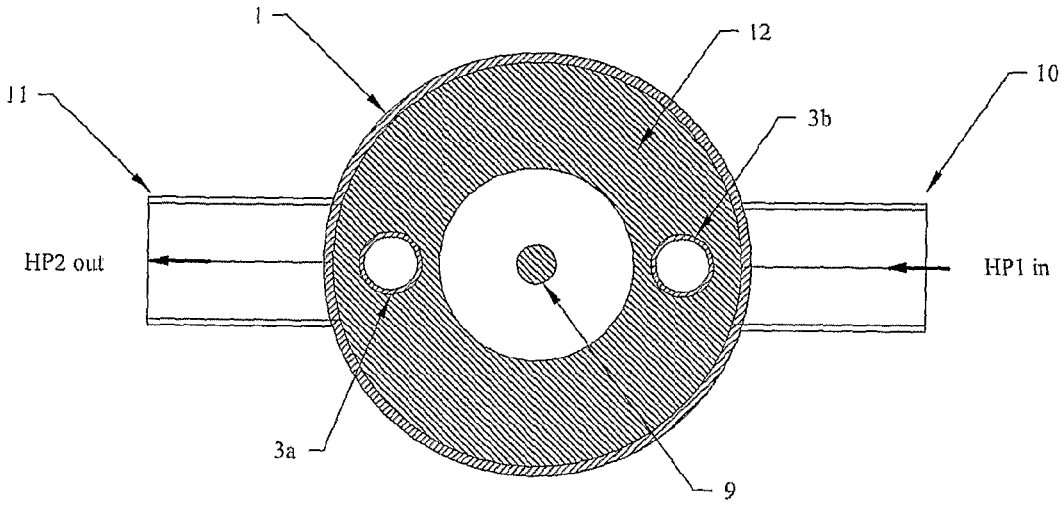
Figure 4:
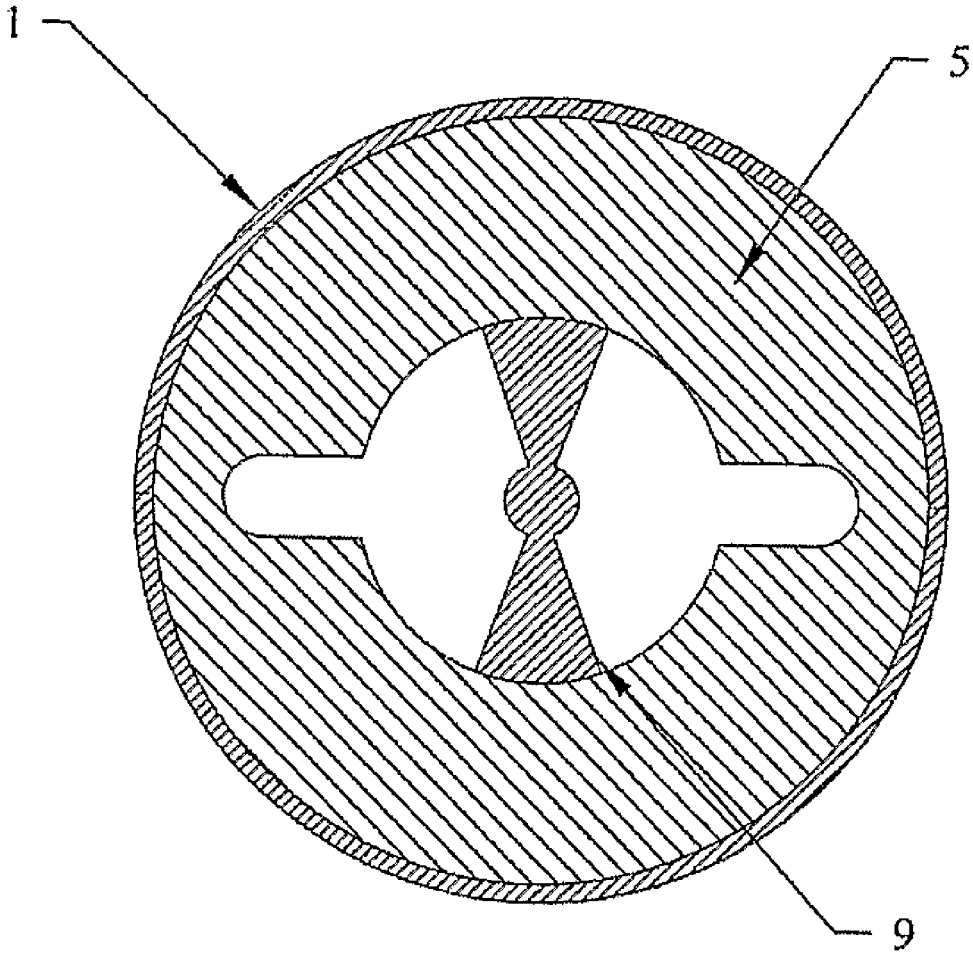
Figure 5:
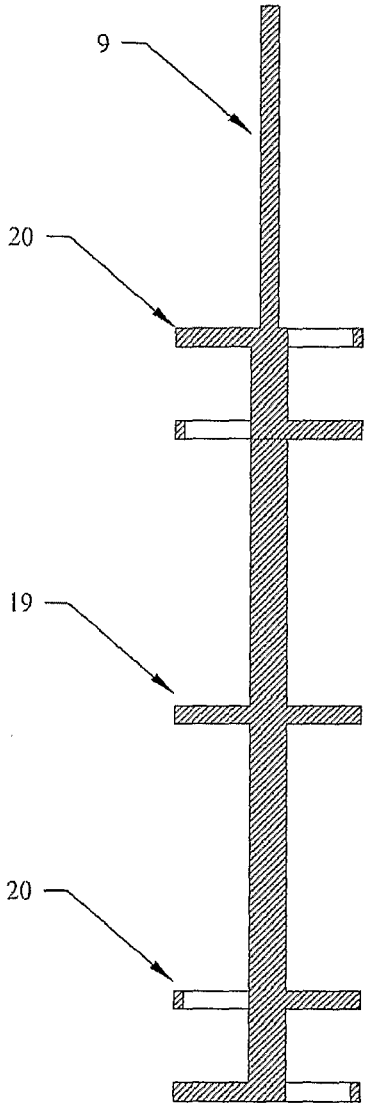
Figure 5A:
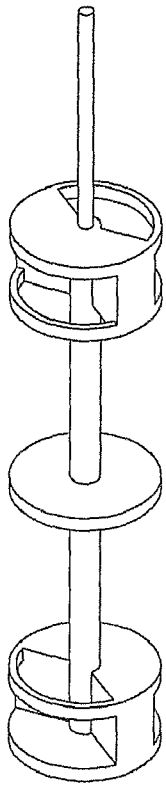
Figure 6:
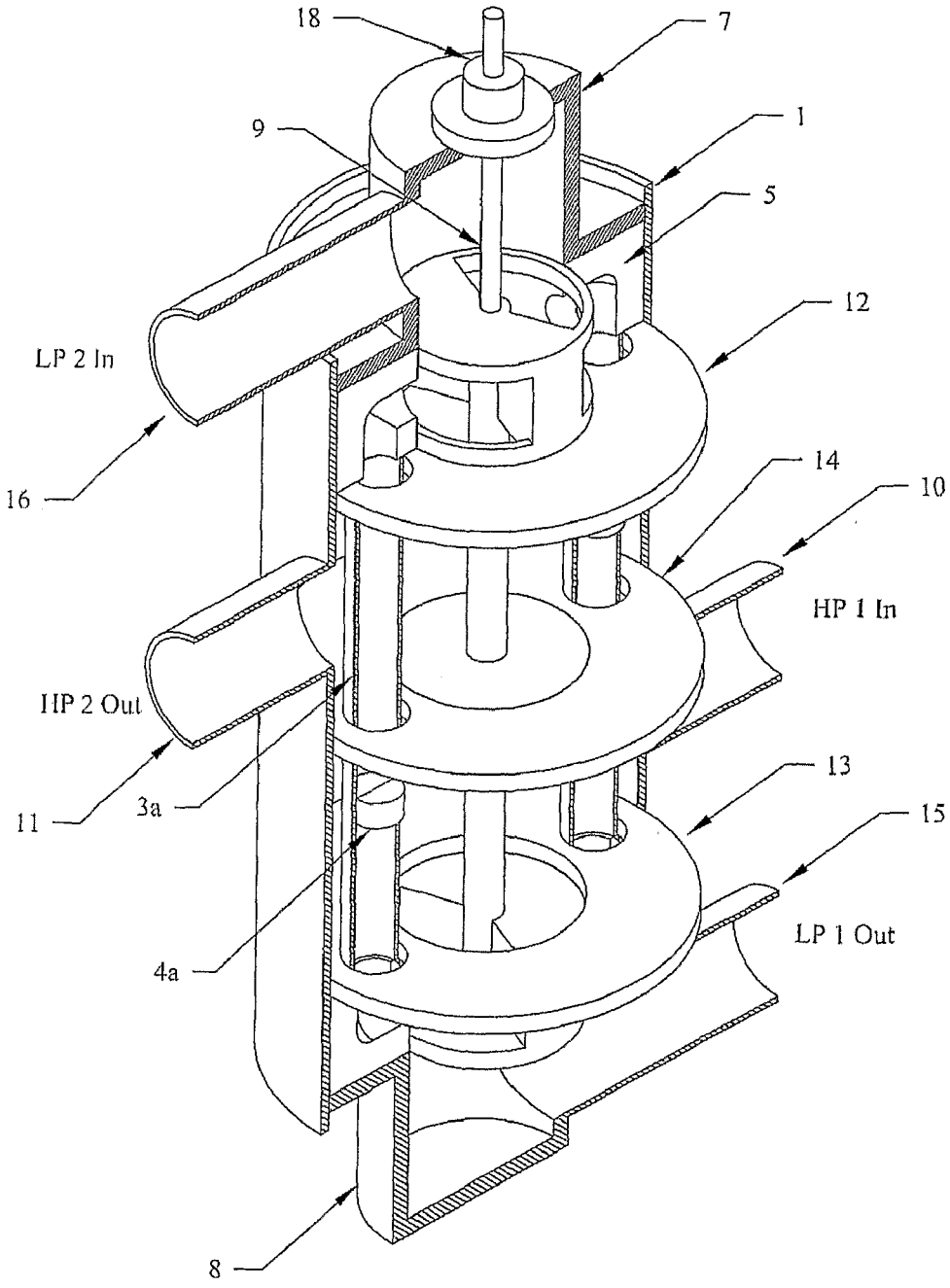
Figure 7A:
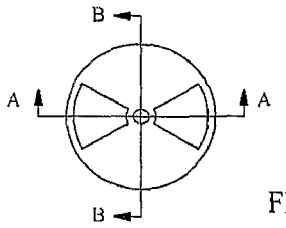
Figure 7B:
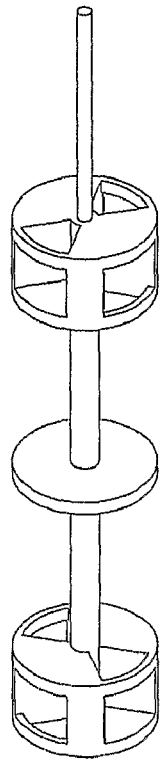
Figure 7:
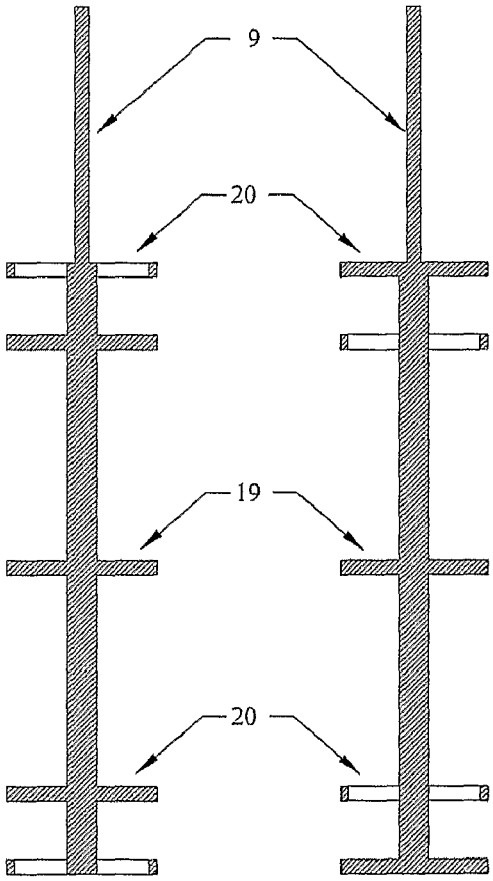
Figure 8:
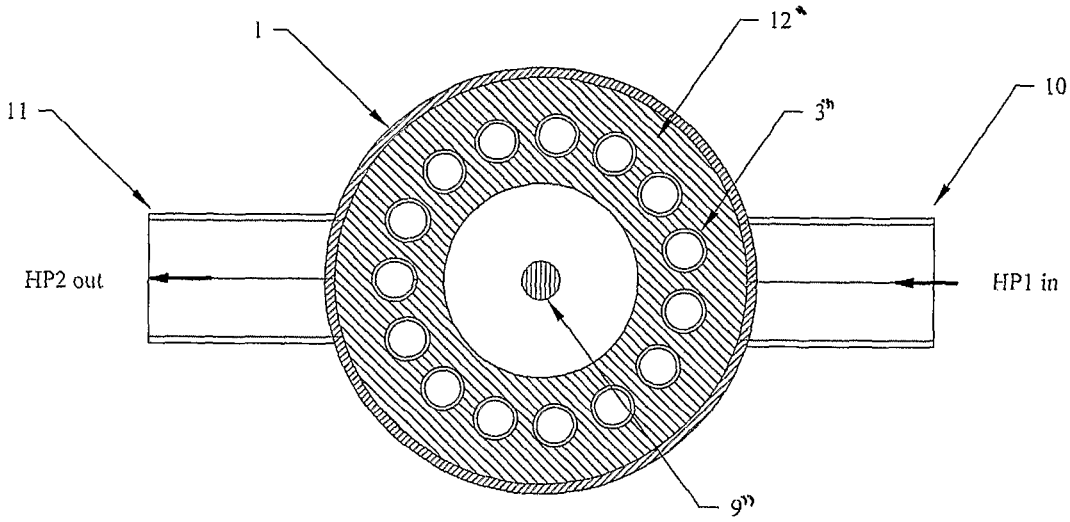
Figure 9:
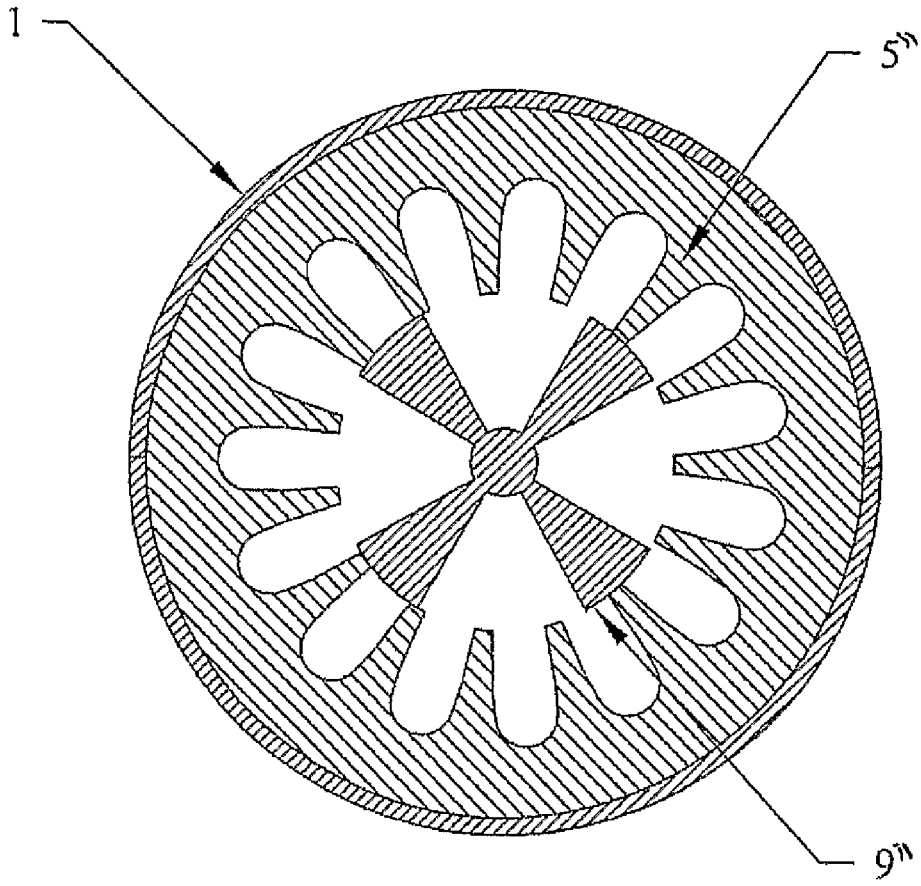
Figure 10:
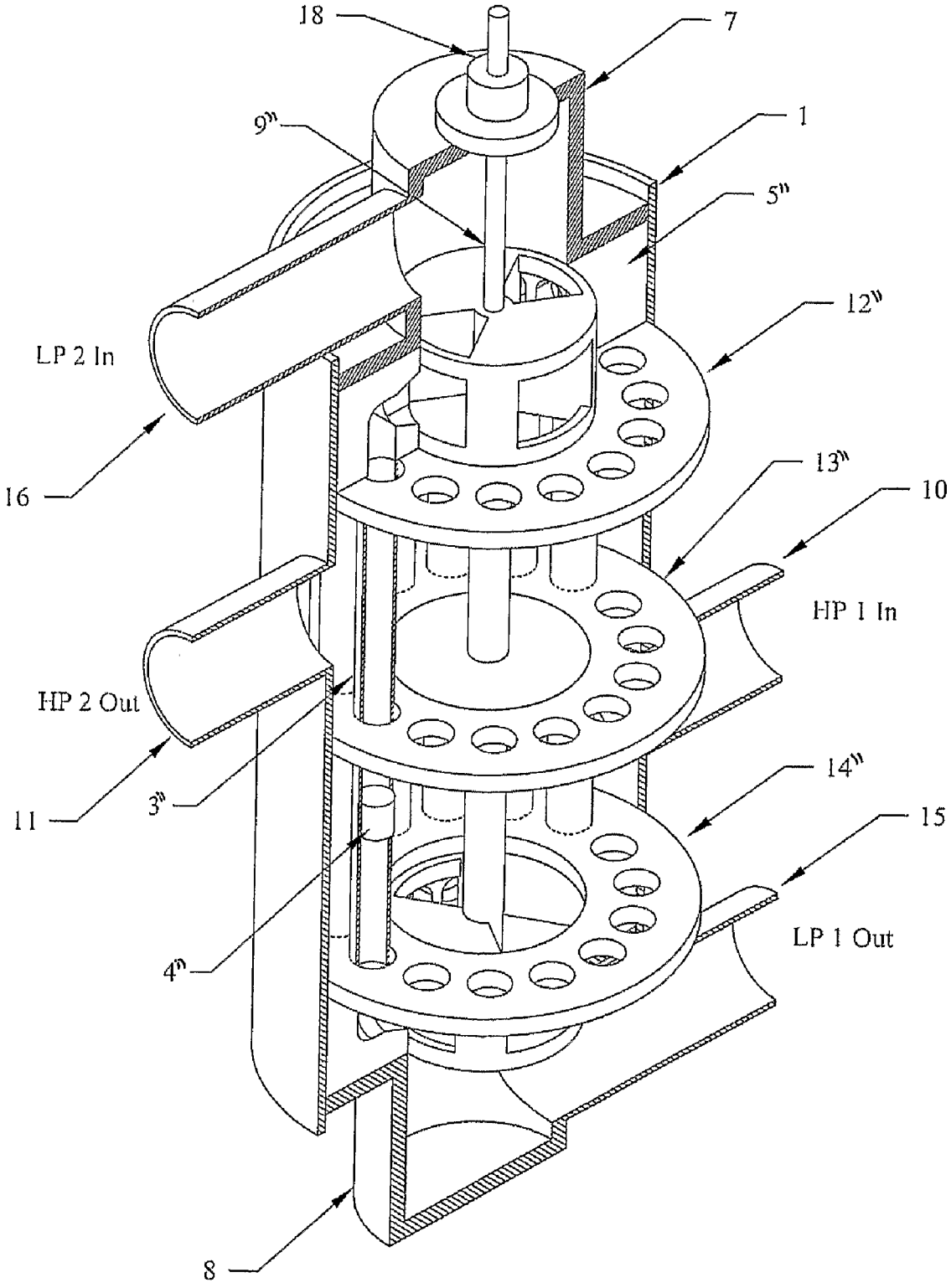

FIG. 2*a* is a perspective view of the pressure vessel of FIG. 2;

FIG. 3 is a cross-sectional view though line A-A of FIG. 1;

FIG. 4 is a cross-sectional view through line B-B of FIG. 1;

FIG. 5 is a cross-sectional view of the valve element of the exchanger of FIG. 1;

FIG. 5*a* is a perspective view of the valve element of FIG. 5;

FIG. 6 is a perspective cutaway view of FIG. 1;

FIG. 7 is a cross-sectional view of a valve element of a preferred embodiment;

FIG. 7*a* is a cross-sectional view through the centre of one of the valve elements of FIG. 7;

FIG. 7*b* is a perspective view of the valve element of FIG. 7;

FIG. 8 is an equivalent preferred embodiment cross-sectional view though line A-A of FIG. 1;

FIG. 9 is an equivalent preferred embodiment cross-sectional view through line B-B of FIG. 1; and FIG. 10 is a perspective cutaway of a preferred embodiment of machine.

Referring first to FIG. 1, a simplified embodiment of the pressure exchange machine in accordance with the present invention is generally shown.

A pressure vessel 1 is provided with a first port 10 acting as a high pressure inlet of a first stream ("HP1 in") and a second port 11 acting as a high pressure outlet ("HP2 out"). The pressure vessel 1, shown in more detail in FIGS. 2 and 2*a*, includes three septum plates 12-14 attached thereto. The septum plates 12 and 13 are located towards either end of the vessel 1, and the plate 14 is located towards its centre.

The three septum plates 12-14 of the pressure vessel 1 are bored out in substantially the same configuration as shown in FIG. 3, which shows the section A-A of FIG. 1. FIG. 3 also shows the two exchange ducts 3*a* and 3*b*, which are arranged around the outer ring of the septum plates.

Referring again to FIG. 1, duct pistons 4*a* and 4*b* are provided in the exchanger ducts 3*a* and 3*b*, respectively, to reduce mixing between the two fluid streams.

Sealingly installed at each end of the exchange ducts 3*a* and 3*b* and on the outside of septum plates 12 and 13 are flow distributors 5 and 6, which channel the flow individually of each exchange duct 3*a*, 3*b* radially towards the centre of the machine. The flow distributor 5 is illustrated in better detail in FIG. 4, which shows the section B-B of FIG. 1. The flow distributors 5, 6 have the net effect that there is a duct to/from the end of each exchange duct 3*a*, 3*b* to/from approximately the diameter of the valve element 9, as explained in further detail below.

The bottom of the pressure vessel 1 is sealed by the bottom sealing plate 8, which also incorporates port 15 for the low pressure stream outlet of the first stream ("LP1 out"). The bottom sealing plate 8 is secured and sealed to the pressure vessel 1.

Rotatable valve element 9 is located in the centre of the machine, that is along its longitudinal axis. Referring to FIGS. 5 and 5*a*, the valve element 9 includes a centre plate 19, which is utilized to separate high pressure streams "HP1 in" and "HP2 out", and incorporates a seal on its outer perimeter, which rotatingly seals with the inner diameter of the septum plate 14. It should be noted that in normal operation the pressure difference between the two high pressure streams is only the pressure drop in the high pressure portion of the machine, so this seal has to cope with a relatively low pressure differential.

At each end of the valve element 9 are valves 20, of similar design to one another and each including two circular plates with partial circles cut out in the manner shown in FIG. 5*a*, and with an axial seal between the plates having a butterfly shape as shown in FIG. 4. The valves 20 ensure that as the valve element 9 rotates the exchange ducts 3*a* and 3*b* are either both isolated, or that one is exposed to high pressure while the other is exposed to low pressure. The outer perimeter of the valve elements 20 are provided with seals similar to a wear ring utilized on centrifugal pump impellers.

As can be best seen in FIG. 1, the top of the pressure vessel 1 is sealed with a top sealing unit or plate 7, which also incorporates port 16 for the low pressure stream inlet of the second stream ("LP2 in"). There are also provided on the unit 7 a fluid seal and thrust bearing 18 for the valve element 9 shaft, as well as means for effecting rotation of the valve element 9, such as a coupling to an electric motor. The top sealing plate 7 is secured and sealed to the pressure vessel 1.

FIG. 6 shows a perspective cutaway drawing of the simplified embodiment of the exchanger shown in FIG. 1, serving better to illustrate the features disclosed above.

In operation, the "HP1 in" fluid stream is introduced to the machine at high pressure through port 10 and flows around the outside of the exchange duct 3*b* towards the centre of the machine. The stream then flows downwardly to the valve, where it then passes through the open ports of the valve element 9 and into the flow distributor 6. The stream then passes into and upwardly in the exchange duct 3*a*, causing upward displacement of the duct piston 4*a*, resulting in the pressurization and flow of the second fluid above the duct piston 4*a*.

The second fluid then flows into the upper flow distributor 5, into the valve element 9, and then downwardly and finally around the outside of the exchange duct 3*a* and out through the high pressure port 11, where it leaves as "HP2 out". Thus, the flow and pressure of "HP1 in" has been transferred to "HP2 out".

At the same time as the above is taking place, the "LP2 in" stream is introduced to the machine at low pressure through port 16. This flows into the valve element 9 and then into the flow distributor 5. From the flow distributor 5 it flows and downwardly into the exchange duct 3*b*, causing downward displacement of duct piston 4*b* and resulting in flow of the first fluid below the duct piston 4*b*, which then flows into the lower flow distributor 6, into the valve element 9, and then, out of the lower sealing plate 8 at port 15 for "LP1 out". Thus the flow and pressure of "LP2 in" has been transferred to "LP1 out" at low pressure.

As the valve element 9 rotates, first the exchange ducts 3*a* and 3*b* are both isolated at both ends, by the respective valve 20. Upon further rotation of the valve 20, the exchange ducts 3*a* and 3*b* are again opened to the flow, but exchange duct 3*a* operates at low pressure, with flow in the opposite direction, and exchange duct 3*b* operates at high pressure, in both cases with the flow in the opposite direction. Thus, by continued rotation, the pressure and flow of stream "HP1 in" is intermittent, but is transferred to the stream "HP2 out".

In operation, the pressure of stream "LP2 in" would be adjusted to ensure, as best as possible, that effectively all of stream "LP1 out" is displaced from the exchange ducts 3, by the duct pistons 4 hitting the flow distributor 6. In addition, the rotational speed of the valve element 9 would be adjusted to ensure, as best as possible, that the duct pistons 4 do not hit the flow distributor 6 before closing off, isolation and reversal of the flow.

It should be noted that the axial thrust on the valve element 9 is low, provided that the pressure drops on the high and low pressure flows are low. Thus, bearing 18 is not required to oppose a large amount of thrust.

The simplified embodiment described above provides a workable design, and well serves to teach the basis of the invention. However, it is preferred, in addition to the features of the simplified embodiments described above, to include one or more of the following features, which can result in a smoother operating and better balanced machine.

The simplified embodiment described above incorporates valves 20 that have one segment of high pressure on one side and one segment of low pressure opposing it, which results in significant radial forces on the valves 20. To reduce such radial forces, the preferred embodiments would incorporate two segments of equal size of high pressure opposing one another, interspersed by two segments of equal size of low pressure opposing one another, as shown for the modified valve element 9' in FIGS. 7, 7*a* and 7*b*.

The simplified embodiment described above includes two exchange ducts 3, which results in both the high pressure and low pressure flow being restricted for part of the rotation of the valve element 9. The preferred embodiments would have more than two exchange ducts 3, such that neither the high pressure or low pressure flow are restricted as the valve element 9 rotates.

When utilizing the two opposing segments of both high pressure and low pressure in the valves 20 mentioned above, the preferred number of exchange ducts 3 is fifteen, as it results in exchange ducts 3 being closed and opened at different times, to result in a smoother operation, as shown in FIGS. 7 to 10. In these Figures the same reference numerals have been used to denote the equivalent components to the embodiment shown in FIGS. 1 to 6, appropriately suffixed in the case where a component has been modified to accommodate for fifteen exchange ducts.

It is to be understood that the teachings herein are not limited to the illustrations or preferred embodiments described, which are deemed to illustrate the best modes of carrying out these teachings, and which are susceptible to modification of form, size, arrangement of parts and details of operation.

The following are examples of such modifications that could be made to the preferred embodiment.

The high and low pressure port connection for each flow stream could be reversed, such that stream "HP1 in", "LP1 out", "HP2 in" and "LP2 out" are connected to ports 15, 10, 16 and 11, respectively.

The duct pistons 4 could be eliminated, which would result in more mixing between the two fluid streams, but would have implications of lower maintenance and noise.

The duct pistons 4 are shown in the preferred embodiment to be solid cylinders. Depending on the design of piping and equipment external to the machine, water hammer and/or excessive differential pressure across the duct pistons 4 could result when the pistons 4 reach the end of their stroke. To reduce this effect, the duct pistons 4 may have built into them orifices or a relief device for relieving trans-piston pressures or may be designed to enter into an area at the end of their stroke which allows bypassing of the fluid on the outside of the duct pistons 4.

The exchange ducts 3 are shown in the preferred embodiment to be circular, but they may be of other cross sectional shapes, such as oval or pie-shaped.

The preferred embodiment shows the exchange ducts 3 to be all located on the same radius from the centre of the machine but this is not necessary and a more compact machine may be achieved by having exchange ducts 3 on differing radii from the centre of the machine.

The preferred embodiment shows the valve element 9 as consisting of two valves 20 mounted on a common shaft. The same effect could be achieved by eliminating the common shaft and having each valve being a separate valve element with its own shaft protruding from the machine with separate but synchronized external rotating drives.

The invention claimed is:

1. A device for exchanging pressures between a plurality of liquid streams, the device including:

a plurality of liquid exchange ducts mounted on a non-rotating part of the device and arranged radially around a longitudinal axis of the device, wherein the exchange ducts extend longitudinally from a first end to a second end;

a rotating valve element for directing flow to and from the liquid exchange ducts; and a pressure vessel cooperative with the liquid exchange ducts and the valve element such that a first compartment and a second compartment with respective inlet and outlet flow connections are formed thereby, where rotation of the valve element around the longitudinal axis of the device provides for the exchange of pressure between liquid in the first and second compartments through the liquid exchange ducts.

2. A pressure exchanger according to claim 1, wherein the valve element comprises a plurality of valves for opening and closing access to the exchange ducts, wherein the first of said valves is operable to direct flow to or from the first end of the exchange ducts and the second of said valves is operable to direct flow to or from the second end of the exchange ducts, wherein each of the plurality of valves is provided with at least one inner opening and an equal number of outer openings which alternatively fluidly connect to respective ends of the liquid exchanger ducts.

3. A pressure exchanger according to claim 2, wherein each of the plurality of valves is mounted on a common shaft.

4. A pressure exchanger according to claim 2, wherein the each of the plurality of valves is mounted on a separate shaft.

5. A method of exchanging pressure between different liquid flows, the method comprising:

providing a pressure exchanger machine including a plurality of liquid exchange ducts mounted on a non-rotating part of the machine and arranged radially around a longitudinal axis of the device, wherein the exchange ducts extend longitudinally from a first end to a second end; a rotating valve element for directing liquid flow between the liquid exchange ducts, wherein the rotating valve element rotates around the longitudinal axis of the device; and a pressure vessel surrounding the exchanger ducts and valve element, the pressure vessel additionally including first and second compartments and inlet and outlet flow connections;

introducing a relatively high pressure liquid into one of the first and second compartments;

introducing a relatively low pressure liquid into another of the first and second compartments;

operating the valve element such that pressures from the relatively high pressure liquid in the one compartment are imparted to the relatively low pressure liquid in the other compartment while pressures from the relatively low pressure liquid in the other compartment are imparted to the relatively high pressure liquid in the one compartment; and discharging the liquids that have had changes in pressure imparted to them through the liquid exchange ducts while keeping the liquid exchange ducts substantially still.

6. The method of claim 5, wherein the pressure exchanger machine is cooperative with a reverse osmosis device such that the relatively low pressure fluid stream introduced into the other of the first and second compartments comprises a saline solution stream and the relatively high pressure fluid stream comprises a brine solution stream.

7. The device of claim 1, wherein the device is cooperative with a reverse osmosis pressure exchanger such that inlet and outlet flow connections comprise a saline solution stream inlet, a saline solution stream outlet, a brine solution stream inlet and a brine solution stream outlet.

8. The device of claim 1, wherein the at least one valve comprises a plurality of valves for opening and closing access to the liquid exchange ducts such that a first of the plurality of valves is operable to direct flow to or from the first end of the plurality of exchange ducts and a second of the plurality of valves is operable to direct flow to or from the second end of the plurality of exchange ducts, wherein each of the liquid exchanger ducts further comprises a piston disposed therein that is movably-responsive to pressure changes imparted from at least one of a relatively high pressure liquid and a relatively low pressure liquid being introduced thereto.

9. A method of operating a machine to exchange pressures between a plurality of liquids, the method comprising:

configuring the machine to comprise:

a pressure vessel defining a plurality of compartments therein such that during operation of the pressure vessel, the plurality of compartments are maintained in a relatively high pressure condition;

a plurality of exchange ducts fixed relative to the pressure vessel and arranged radially around a longitudinal axis of the device, wherein the exchange ducts extend longitudinally from a first end to a second end, and are configured to be in fluid communication with at least one of a higher pressure liquid stream and a lower pressure liquid stream; and a valve element to provide selective hydraulic communication between the plurality of exchange ducts and the plurality of compartments;

introducing the lower pressure liquid stream into a first of the plurality of exchange ducts such that a liquid previously contained therein is discharged from the machine in the form of a low pressure outlet;

introducing the higher pressure liquid stream into a second of the plurality of exchange ducts such that a liquid previously contained therein is discharged from the machine in the form of a high pressure outlet;

rotating the valve element around the longitudinal axis of the device to a first position sufficient to allow the relatively high pressure condition within at least one of the plurality of compartments to pressurize the introduced lower pressure liquid; and rotating the valve element around the longitudinal axis of the device to a second position that is different from the first position and sufficient to allow the introducing of the lower pressure liquid stream and the higher pressure liquid stream into their respective first and second of the plurality of exchange ducts to be repeated.

10. The method of claim 9, wherein each of the first and second exchange ducts comprise a piston disposed therein that is movably responsive to pressure changes produced by the introduced liquid streams and the relatively high pressure condition within at least one of the plurality of compartments, the piston configured to provide substantial fluid isolation between opposing sides thereof.

11. The method of claim 9, wherein the lower pressure liquid stream comprises a saline solution stream and the higher pressure liquid stream comprises a brine solution stream.

12. The method of claim 11, further comprising passing the brine solution stream through a reverse osmosis device prior to introducing it into the second of the plurality of exchange ducts.

13. The method of claim 9, wherein each of the plurality of compartments is adjacent one another such a pressure differential present between each of the plurality of compartments is kept to a minimum.

14. The method of claim 9, wherein the lower pressure liquid stream and the higher pressure liquid stream are introduced into their respective exchange ducts substantially simultaneously.

15. The method of claim 9, wherein the operation is configured such that upon discharge of the low pressure output, such liquid is not substantially reintroduced into either the higher pressure liquid stream or the lower pressure liquid stream.

* * * * *

UNITED STATES PATENT AND TRADEMARK OFFICE

CERTIFICATE OF CORRECTION

PATENT NO. : 8,308,444 B2
APPLICATION NO. : 12/092970
DATED : November 13, 2012
INVENTOR(S) : William T. Andrews It is certified that error appears in the above-identified patent and that said Letters Patent is hereby corrected as shown below:

In the Specifications:

Col. 4, Line 1, “though” should read --through--; and

Col. 4, Line 15, “though” should read --through--.

Signed and Sealed this
Twenty-fifth Day of June, 2013

Teresa Stanek Rea
*Acting Director of the United States Patent and Trademark Office*